United States Patent [19]

Penick

[11] Patent Number: 4,593,759

[45] Date of Patent: Jun. 10, 1986

[54] METHOD FOR THE RECOVERY OF VISCOUS OIL UTILIZING MIXTURES OF STEAM AND OXYGEN

[75] Inventor: Joe E. Penick, Chappaqua, N.Y.

[73] Assignee: Mobil Oil Corporation, New York, N.Y.

[21] Appl. No.: 558,406

[22] Filed: Dec. 5, 1983

[51] Int. Cl.[4] ..... E21B 43/243

[52] U.S. Cl. ..... 166/261; 166/272

[58] Field of Search ..... 166/261, 272, 303

[56] References Cited

U.S. PATENT DOCUMENTS

| | | | |
|---|---|---|---|
| 3,010,707 | 11/1961 | Craighead et al. | 166/272 X |
| 3,369,604 | 2/1968 | Black et al. | 166/261 |
| 3,563,312 | 2/1971 | Zwicky | 166/261 |
| 3,976,137 | 8/1976 | Bousaid | 166/272 |
| 4,006,778 | 2/1977 | Redford et al. | 166/303 X |
| 4,046,195 | 9/1977 | Cram et al. | 166/272 |
| 4,048,078 | 9/1977 | Allen | 166/261 X |
| 4,059,152 | 11/1977 | Allen et al. | 166/272 X |
| 4,114,690 | 9/1978 | Cram et al. | 166/261 |
| 4,127,172 | 11/1978 | Redford et al. | 166/272 X |

*Primary Examiner*—George A. Suchfield

*Attorney, Agent, or Firm*—Alexander J. McKillop; Michael G. Gilman; Stanislaus Aksman

[57] ABSTRACT

A method for the recovery of viscous oil from a subterranean formation penetrated by an injection well and a spaced-apart production well by first injecting sufficient steam into the formation via the injection well to displace oil in the formation immediately surrounding the injection well away from the well into the formation and then injecting a mixture of an oxygen-containing gas and steam wherein the ratio of molecular oxygen in the oxygen-containing gas to steam is maintained at a value in the range of 360 to 1800 SCF of oxygen per barrel of steam (cold water equivalent).

5 Claims, No Drawings

METHOD FOR THE RECOVERY OF VISCOUS OIL UTILIZING MIXTURES OF STEAM AND OXYGEN

BACKGROUND OF THE INVENTION

The present invention relates to an improved method for the recovery of oil from subterranean, viscous oil-containing formations. More particularly, the invention relates to a thermal oil recovery process utilizing mixtures of steam and oxygen.

Many oil reservoirs such as heavy oil or tar sand formations have been discovered which contain vast quantities of oil, but little or no oil has been recovered from many of them because the oil present in the resrvoir is so viscous that it is essentially immobile at reservoir conditions, and little or no petroleum flow will occur in a well drilled into the formation even if a natural or artificially induced pressure differential exists between the formation and the well. Some form of supplemental oil recovery must be applied to these formations which decrease the viscosity of the oil sufficiently that it will flow or can be dispersed through the formation to the production well and therethrough to the surface of the earth. Thermal recovery techniques which are quite suitable for viscous oil formations include steam flooding and in-situ combustion.

Steam may be utilized for thermal stimulation for viscous oil production by means of a steam drive or steam throughput process, in which steam is injected into the formation on a more or less continuous basis by means of an injection well and oil is recovered from the formation from a spaced-apart production well.

Conventional in-situ combustion involves drilling of at least two substantially vertical wells into the formation, the wells being separated by a horizontal distance within the formation. One of the wells is designated an injection well, and the other a production well. The recovery of oil is accomplished by raising the temperature of the in-place oil adjacent the injection well to ignition temperature by some suitable means, e.g., with some type of a conventional downhole heater/burner apparatus, or by steam injection and then supporting combustion by injecting an oxygen-containing gas such as air, oxygen-enriched air, oxygen mixed with an inert gas, or substantially pure oxygen. Thereafter, the injection of the oxygen-containing gas is continued so as to maintain the high temperature combustion front which is formed, and to drive the front through the formation toward the production well. As the combustion front moves through the formation, it displaces ahead of it the in-place oil with reduced viscosity as well as other formation fluids such as water and also combustion gas produced during the combustion process. These fluids are recovered from the formation via the production well.

As an improvement to the in-situ combustion process, water or steam may be injected with the oxygen-containing gas which is referred to as wet combustion. Wet combustion reduces the temperature of the in-situ combustion reaction resulting in less consumption of the crude oil present in the formation and increasing the sweep efficiency of the combustion front. U.S. Pat. Nos. 3,976,137, 4,114,690, and 4,127,122 disclose injection of a mixture of an oxygen-containing gas and steam for low temperature, controlled oxidation viscous oil recovery.

The low temperature oxidation (LTO) process has the disadvantage of "wasting" oxygen, i.e., it is a partial oxidation that adds oxygen to hydrocarbons to form oxygenated functional groups such as —OH, —COOH, <C=O, —CHO, etc., instead of causing oxidation all the way to carbon dioxide and water which releases the most heat of combustion. Low temperature oxidation is also associated with the formation of viscous products, usually several orders of magnitude more viscous than the original oil which can lead to plugging of the formation that decreases injectivity of the fluid mixture.

The present invention provides an improved thermal recovery method whereby viscous oils can be recovered more efficiently by injecting a mixture of an oxygen-containing gas and steam wherein the ratio of molecular oxygen in the oxygen-containing gas to steam is about 5 volume percent to 25 volume percent of the injected fluids.

SUMMARY OF THE INVENTION

The invention relates to a method for the recovery of oil from a subterranean, viscous oil-containing formation penetrated by at least one injection well and at least one production well, both wells being in fluid communication with the oil-containing formation, and having fluid communication therebetween comprising the steps of injecting a sufficient amount of steam into the formation via the injection well to displace oil in the formation immediately surrounding the injection well away from the well through the formation, and thereafter injecting a mixture of steam and an oxygen-containing gas into the formation via the injection well wherein the ratio of the molecular oxygen in the oxygen-containing gas to steam is within the range of 360 to 1800 SCF of oxygen per barrel of steam (cold water equivalent), and recovering fluid including oil and effluent gas from the formation via the production well. The oxygen-containing gas may be air, oxygen-enriched air, substantially pure oxygen or mixtures of oxygen and gases such as nitrogen, carbon dioxide and flue gas.

DESCRIPTION OF THE PREFERRED EMBODIMENTS

The process of this invention is best applied to a subterranean, viscous oil-containing formation such as a heavy oil or tar sand deposit penetrated by at least one injection well and at least one spaced-apart production well. The injection and production wells are in fluid communication with a substantial portion of the oil-containing formation by means of perforations. While recovery of the type contemplated by the present invention may be carried out by employing only two wells, it is to be understood that the invention is not limited to any particular number of wells. The invention may be practiced using a variety of well patterns as is well known in the art of oil recovery, such as an inverted five spot pattern in which an injection well is surrounded with four production wells, or in a line drive arrangement in which a series of aligned injection wells and a series of aligned production wells are utilized. Any number of wells which may be arranged according to any pattern may be applied in using the present method as illustrated in U.S. Pat. No. 3,927,716 to Burdyn et al, the disclosure of which is hereby incorporated by reference. Either naturally occurring or artificially induced fluid communication should exist between the injection well and the production well. If it is determined that the formation does not possess sufficient naturally occurring permeability to fluids such as steam and other fluids, adequate fluid communication can be induced by cyclic steam or solvent stimulation and/or fracturing procedures well known in the art.

Initially, steam is injected into the formation via the injection well in an amount sufficient to displace oil in the formation immediately surrounding the injection well away from the well through the formation. Displacement of oil in the formation immediately surrounding the injection well away from the well avoids residual oil from the formation near the injection well coming into contact with subsequently injected oxygen thereby eliminating the dangerous phase during the injection of oxygen that could cause catastrophic wellbore fires or explosions. In addition, the injected steam also displaces hydrocarbon (or oxidizable) material in the tubular goods and downhole portion of the injection well that could lead to uncontrolled reactions such as ignition and burning of metal equipment in the presence of oxygen. The amount of steam injected will vary depending upon the method of well completion and characteristics of the formation such as vertical thickness, oil saturation, oil viscosity, and permeability.

Thereafter, a mixture of an oxygen-containing gas and steam is injected into the formation via the injection well in which the ratio of the molecular oxygen in the oxygen-containing gas to steam is within the range of 360 to 1800 SCF of oxygen per barrel of steam (cold water equivalent) or about 5 volume percent to 25 volume percent oxygen of the injected fluids, and fluids including oil and effluent gas are recovered from the formation via the production well. Steam injection temperature is within the range of 350° F. to 650° F. and quality is in the range of 50% to about 90%. It is desirable that the injection be accomplished at the maximum flow rate possible consistent with the pressure limitations of the formation.

The oxygen-containing gas may be air, oxygen-enriched air, substantially pure oxygen or mixtures of oxygen and gases such as nitrogen, carbon dioxide and flue gas with the preferred oxygen-containing gas being substantially pure oxygen. By the term "oxygen-containing gas" is meant that the gas mixture contains molecular oxygen as one component. While air may be used, the resultant dilution of streams with nitrogen and the cost of compressing the nitrogen to injection pressures makes the use of air less desirable.

The steam and oxygen-containing gas may be introduced into the injection well through separate flow lines and commingled upon introduction into the oil zone, or commingled prior to injection into the well.

Injection of the mixture of oxygen-containing gas and steam and production of fluid including oil and effluent gas is continued so long as oil is produced at a reasonable or economic rate.

As the mixture of steam and oxygen having the rates of oxygen to steam defined above flows through the oil-containing formation, the steam gives up its heat to the formation by condensation and the oxygen reacts with in-place crude oil or residue thereof remaining after displacement by injected fluids to establish an in-situ combustion front and form carbon dioxide and water. The heat generated by combustion reduces the viscosity of the in-place oil and as the combustion front progresses through the formation, it drives the mobilized oil toward the production well from which it is recovered. Using the ratio of oxygen and steam according to the present invention avoids low temperature oxidation of the in-place oil which wastes oxygen as previously described due to partial oxidation that adds oxygen to hydrocarbons as oxygenated functional groups such as —OH, —COOH, <C=O, —CHO, etc., instead of causing oxidation all the way to carbon dioxide and water which releases the most heat of combustion. In addition, generation of carbon dioxide results in significant solubility of $CO_2$ in the cold oil which further enhances its displacement toward the production well as a result of viscosity reduction and swelling, etc. The present process thereby enhances oil recovery over that obtainable by injection of steam alone by heating a greater volume of the formation, improving sweep efficiency and increasing reduction of in-place oil viscosity.

The produced effluent gas from the production well is continuously analyzed for oxygen content to avoid hazardous underground and production well conditions due to undesirable concentrations of oxygen in the produced fluids that may occur due to unanticipated oxygen breakthrough or more particularly during the more advanced stage of the process. If the oxygen content of the produced effluent gas increases to an unsafe level, injection of the mixture of oxygen-containing gas and steam may be reduced or terminated while continuing injection of steam and production of oil. Alternatively, if the oxygen content of the produced effluent gas increases to an unsafe level, the production well may be shut-in to the extent necessary to obtain the desired flow distribution to other producing wells thereby effecting improved sweep efficiency and oil recovery.

What is claimed is:

1. A method for the recovery of oil from a subterranean, viscous oil-containing formation penetrated by at least one injection well and at least one production well, both wells being in fluid communication with the oil-containing formation, and having fluid communication therebetween consisting essentially of the following steps in the recited order:

(a) injecting a sufficient amount of steam into the formation via the injection well to displace oil in the formation immediately surrounding the injection well away from the well into the formation;

(b) thereafter injecting a mixture of steam, having a quality of 50 to 90% and the temperature of 350° to 650° F., and an oxygen-containing gas into the formation via the injection well wherein the ratio of molecular oxygen in the oxygen-containing gas to steam is within the range of 360 to 1800 SCF of oxygen per barrel of steam (cold water equivalent) to effect a substantially complete combustion of at least a portion of the oil to carbon dioxide and water; and (c) recovering fluid including oil from the formation via the production well.

2. The method of claim 1 wherein the oxygen-containing gas is substantially pure oxygen.

3. The method of claim 1 wherein the oxygen-containing gas is air.

4. The method of claim 1 wherein the oxygen-containing gas is oxygen-enriched air.

5. The method of claim 1 wherein the oxygen-containing gas is oxygen and nitrogan oxygen an carbon dioxide, oxygen and flue gas or mixtures thereof.

* * * * *

UNITED STATES PATENT AND TRADEMARK OFFICE

CERTIFICATE OF CORRECTION

PATENT NO. : 4,593,759

DATED : June 10, 1986

INVENTOR(S) : Joseph E. Penick

It is certified that error appears in the above-identified patent and that said Letters Patent is hereby corrected as shown below:

Col. 1, line 14: "resrvoir" should read --reservoir--.

Col. 4, line 64: "an" should read --and--.

Signed and Sealed this

*Ninth* Day of *September 1986*

[SEAL]

*Attest:*

DONALD J. QUIGG

*Attesting Officer*

*Commissioner of Patents and Trademarks*